United States Patent [19]

Berthet et al.

[11] Patent Number: 4,627,601

[45] Date of Patent: Dec. 9, 1986

[54] INSTALLATION FOR THE PRODUCTION OF STEEL BY PRE-SMELTING OF PIG IRON

[75] Inventors: Aristide Berthet; Guy Denier, both of Metz, France

[73] Assignee: IRSID, Maizieres-les-Metz, France

[21] Appl. No.: 748,118

[22] Filed: Jun. 24, 1985

[30] Foreign Application Priority Data

Jun. 22, 1984 [FR] France ..... 84 09819

[51] Int. Cl.[4] ..... C21C 1/00

[52] U.S. Cl. ..... 266/212; 75/46; 266/227

[58] Field of Search ..... 266/212, 227; 75/46

[56] References Cited

U.S. PATENT DOCUMENTS

| | | | |
|---|---|---|---|
| 3,809,379 | 5/1974 | Carbonnel | 266/212 |
| 4,084,959 | 4/1978 | Yamamoto | 75/46 |
| 4,140,521 | 2/1979 | Galnbek | 75/46 |
| 4,457,777 | 6/1984 | MacGregor | 75/46 |

*Primary Examiner*—Peter D. Rosenberg

[57] ABSTRACT

Installation according to the invention comprising a desilication and dephosphorization stage (A), followed by a decarburization stage and in which the pig iron to be pre-smelted is intended to form a bath whose free surface is maintained at a predetermined level ($N_1$).

The dephosphorization comprises a reactor (1) comprising means (5, 6, 8) respectively for introducing the pig iron to be pre-smelted, for adding desilication and dephosphorization agents, and for creating an oxidizing atmosphere, as well as rabbling means (9). It also comprises a decanter (2) separated from the reactor (1) by a partition (3) having an opening (4) below the level ($N_1$) and whose upper end is above the latter. The decanter comprises an immersed outlet opening (10) connected to the decarburization stage and an overflow (12) for evacuating the slag. The slag formed in the reactor (1) flows out in the decanter (2), overflows above the partition (3), and moves toward the overflow (12) which evacuated it.

8 Claims, 5 Drawing Figures

INSTALLATION FOR THE PRODUCTION OF STEEL BY PRE-SMELTING OF PIG IRON

FIELD OF THE INVENTION

The present invention relates to the production of steel by pre-smelting of pig iron.

BACKGROUND OF THE INVENTION

It is known that an oxygen smelting converter is a reactor which enables, in principle, the removal down to a very low content of the oxidizable elements of the pig iron, the principal ones being carbon, phosphorus and silicon. However, despite significant progress (blasting of oxygen from the bottom, or mixed blasting, from the bottom and from the top), it still seems difficult to obtain results which are well reproducible from one installation to another.

Moreover, the trend in the marketplace toward steel of an increasingly greater degree of purity implies a substantial increase in the manufacturing cost for the details provided on the converter, or even, sometimes, an impossibility of providing for a single converter all the required specifications.

It is known that one response to these problems consists in separating in both time and space the diverse oxidation operations which enable passing from pig iron to steel (desilication, dephosphorization, decarburization), so as to optimize them separately.

The desilication and dephosphorization operations conducted under these conditions characterize what will henceforth be called the pre-treatment, or more precisely the pre-smelting of the pig iron.

The known pre-smelting installations all proceed by sequential operations (desilication, then dephosphorization, then decarburization) on discrete and repetitive quantities of pig iron (see, e.g., British Specification No. 2,072,221).

One part of the liquid pig iron mass to be pre-treated is in effect drawn off successively into several independent metallurgical receptacles, each more or less specialized for the treatment phase to which it is assigned, or placed in a single receptacle, generally a straight ladle, which is brought adjacent to fixed locations for successive treatments distributed in the workship. (French Patent Appln. No. 2,439,821 of NSC).

Whatever their type, these installations still do not give complete satisfication. In particular, the transfers of the pig iron into different receptacles, or from one treatment location to the next, give rise to waiting times, therefore also to thermal losses, and quite often even to a deterioration of the metal yield by reason of intermediate scraping operations for purifying the slag formed in each pre-smelting operating phase. In addition, since the operation is discontinuous, each of these phases is cyclical and therefore involves transitory operating periods which are poorly adapted for control, and which diminish the effectiveness of the entire treatment, and this even on the assumption that the sequence of successive phases can be correctly time-coordinated.

SUMMARY OF THE INVENTION

The present invention is intended to overcome these disadvantages. In order to do so, it has for its object an installation for the production of steel by pre-smelting of the pig iron, comprising a stage of desilication and of dephosphorization, followed by a stage of decarburization, characterized in that the desilication and dephosphorization stage is constituted by at least one closed unit forming a reactor in which the pig iron to be pre-smelted forms a bath whose surface is maintained at a predetermined level $N_1$, the said reactor having, on the one hand, an upper part, above the level $N_1$, provided with means for introducing the pig iron to be pre-smelted, means for introducing agents for oxidizing silicon and phosphorous, as well as agents for the formation of a desilication and dephosphorization slag, and means for creating an oxidizing atmosphere above the bath; and, on the other hand, a lower part, below the level $N_1$, provided with means for rabbling the metallic bath; and a decanter separated from the reactor by a partition comprising a communication opening below the level of the bath $N_1$ and whose upper free end, extending above the said level $N_1$, constitutes a sill encircling the slag formed in the reactor, this decanter comprising, on the one hand, an outlet opening located below the level $N_1$ and communicating with a connecting conduit intended to permit the circulation of a flow of desilicated and dephosphorized pig iron toward the decarburization stage, and, on the other hand, an overflow located above the level $N_1$ for evacuating the decanted desilication and dephosphorization slag coming from the reactor to the exterior.

Preferably, the decarburization stage is constituted by a closed shell forming a second reactor in which the pig iron to be decarburized coming from the connecting conduit with the decanter is intended to form a bath whose free surface is maintained at a predetermined level $N_2$, this reactor comprising an inlet opening located below the level $N_2$ and communicating with the said connecting conduit as well as with means located above the level $N_2$ for insufflating an oxidizing gas decarburizing the pig iron; and a second decanter separated from the reactor by a tight partition whose free upper end, extending above the level $N_2$, constitutes a sill encircling a metal-slag emulsion formed in the reactor under the action of insufflation of the said oxidizing gas, the said decanter having an overflow for evacuating the slag decanted on the metallic bath to the exterior, and an opening under the level of the metallic bath in the decanter for outflow of a liquid steel current.

The installation conforming to the invention is designed to operate continuously and can therefore have a yield distinctly greater than that of existing installations. Besides, as the pig iron can circulate freely from the desilication and dephosphorization stage to the decarburization stage, the transfer devices used heretofore can be omitted, thereby permitting an appreciable reduction in expenditure.

According to a particular embodiment of the invention, the desilication and dephosphorization unit each comprises a reactor separated from a decanter by a partition comprising a communication opening below the predetermined level, and whose upper end is located above this level and forms a sill encircling the slag, the desilication reactor comprising means for introducing the pig iron to be pre-smelted, means for introducing desilication agents, and means for rabbling the metallic bath; the dephosphorization reactor comprising means for introducing the dephosphorization agents, means for creating an oxidizing atmosphere, and means for rabbling the metallic bath; the desilication and dephosphorization decanters comprising means for continuously evacuating the slag which they contain; the desilication decanter being connected to the dephosphorization reactor by a conduit for simple transfer of the pig iron, while the dephosphorization decanter is connected to an immersed link conduit communicating with the decarburization stage.

BRIEF DESCRIPTION OF THE DRAWINGS

Other characteristics and advantages of the present invention will appear from the description which will be given hereafter by way of non-limiting example with reference to the attached drawings in which.

DETAILED DESCRIPTION

Figure 1:
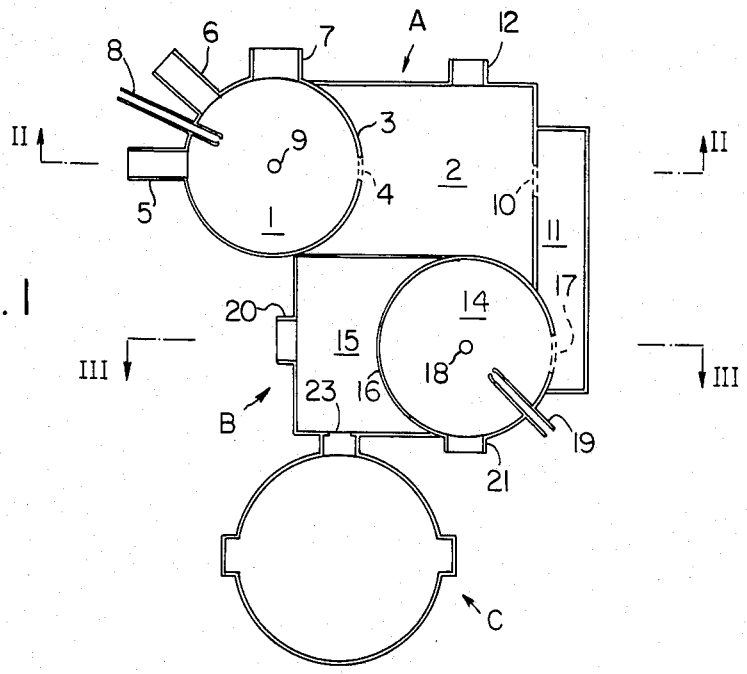
FIG. 1 is a schematic plan view of an installation according to the invention.
Figure 2:
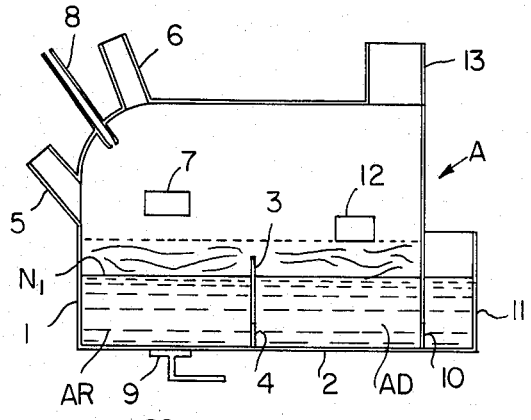
FIG. 2 is a schematic section view along line II—II of FIG. 1.
Figure 3:
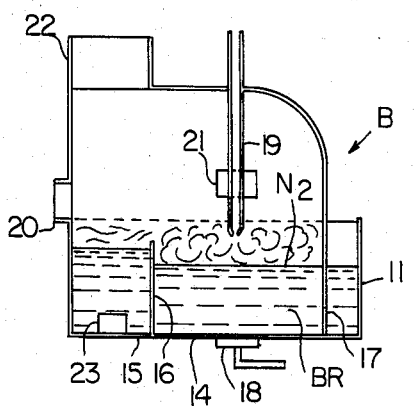
FIG. 3 is a schematic section view along line III—III of FIG. 1.

The installation shown in FIGS. 1 to 3 comprises a desilication and dephosphorization stage constituted by a closed shell A in which the pig iron to be pre-smelted is intended to form a molten bath AR reaching a substantially constant predetermined level $N_1$, a decarburization stage also formed by a closed shell B communicating with the outlet of stage A, and a metallurgical receptacle C provided if necessary for grading the steel leaving the stage A.

The desilication and dephosphorization stage A comprises a first reactor 1 and a continuous first decanter 2 separated from one another by a first partition 3 comprising a communication opening 4 below the level $N_1$ and whose upper end is above the latter.

In its upper part above the metallic bath, the first reactor comprises a spout 5 for introducing the liquid pig iron to be pre-smelted, a conduit 6 for introducing desilication and dephosphorization agents in a solid divided state, a door 7 for eventually introducing cooling additives such as scrap, pre-reduced steel forming material or ore, etc., and a nozzle 8 blowing gaseous oxygen, preferably technically pure, so as to create an oxidizing atmosphere above the pig iron bath. These different means being of conventional design, their structure will not be described. It may however be specified that the nozzle 8 may well be replaced by a pipe fixed in the wall, since if the bath is maintained at a constant level $N_1$, the moveability of the injector of oxygen is no longer desirable.

It may further be pointed out, for what it may be worth, that the desilication agents are generally simple metallic oxides such as iron or manganese ores, and the dephosphorization agents are basic compounds such as sodium carbonate, lime or calcium carbonate, which may, if desired, be specially prepared in agglomerated form and whose basicity is adjusted to the value desired.

In its part located below the level $N_1$, and more precisely at its bottom, the first reactor 1 further comprises means 9 for rabbling the metallic bath, these means being able for example to be constituted by rabbling fluid injectors such as permeable refractory elements connected to a supply (not shown) of gas under pressure, such as, for example, nitrogen or argon.

The permeable refractory elements can advantageously be of the type described in European Pat. No. 0 021 861.

As for the first decanter 2, this comprises an outlet opening 10 located below the level $N_1$ and connected to a connecting conduit 11, such as a siphon designed to transfer simply and continuously the desilicated and dephosphorized pig iron AD from the decanter toward the decarburization stage A. It also comprises, above the level $N_1$, and preferably in a position at a distance from the reactor, a cleansing overflow 12 for evacuating continuously the desilication and dephosphorization slag provided in the reactor 1, then passed into the calm enclosure of the decnater by overflowing above the sill which constitutes the free upper end of the separation partition 3. A chimney for extracting the fumes is also provided at the end of the decanter distant from the reactor.

As for the carburization stage B, this comprises a second reactor 14 in which the bath BR of the pig iron to be decarburized is intended to form a molten bath attaining a predetermined level $N_2$, and a second decanter 15 separated from the reactor 14 by a tight partition 16 whose upper end is above the level $N_2$.

The second reactor 14 comprises, in its part located below the level $N_2$, an inlet opening 17 communicating with the siphon 11, and means 18 for pneumatic rabbling of the bath, which may be of the type provided in the base of the first reactor 1. It further comprises means 19 for insufflating an oxidizing gas above the pig iron bath which it contains, these means being, for example, an oxygen nozzle, as well as door 21 for eventually introducing cooling materials, such as scrap.

In the illustrated embodiment, the levels $N_1$ and $N_2$ are at the same height since the reactor 1, the decanter 2 and the reactor 14 communicate with each other according to the principle of communicating vessels. It goes without saying, however, that the level $N_2$ could have a height lower than that of level $N_1$, e.g., if the siphon 11 were replaced by an adjustable flow conduit.

As for the second decanter 15, it comprises an overflow 20 for evacuating the decarburization slag, a chimney 22 for extracting the fumes, and an outlet orifice 23 intended for evacuating the smelted pig iron toward the grading furnace C.

In order to produce steel with the installation shown in FIGS. 1 to 3, one proceeds in the following manner:

one introduces continuously into the first reactor 1 pig iron to be pre-smelted and desilication and dephosphorization agents through the spout 5 and the conduit 6, respectively;

one creates an oxidizing atmosphere above this bath by actuating the means 8, and if needed one adds through the door 7 cooling materials into the first reactor so as to maintain the metallic bath at the desired production temperature;

on actuates the rabbling means 9 and 18 of stages A and B;

one insufflates through nozzle 19 a predetermined flow of $O_2$ in order to assure the decarburization of the pig iron in the second reactor 15; and if desired, one adds cooling materials to the pig iron through the door 21 for thermal adjustment.

The silicon and the phosphorus of the pig iron contained in the first reactor 1 oxidize on contact with the oxygen brought by the ore, and the oxides which are produced are fixed in the slag formed by the desilication and dephosphorization agents and whose major portion floats on the surface of the molten bath. This slag, being continuously produced, constantly overflows above the partition 3 and reaches the first decanter 2 so as to move toward the overflow 12, which assures its continuous evacuation.

The pig iron, largely desilicated and dephosphorized in the first reactor 1, continuously passes through the communication opening 4 of the partition 3 and thus reaches the first decanter 2 in which the desilication and the dephosphorization are calmly achieved, at the same time as occurs the separation of the metal and of the slag which are fairly well mixed in the reactor under the conjugated influence of the oxidation and pneumatic rabbling reactions of the bath.

The desilicated and dephosphorized pig iron then flows out of the decanter 2 through the passage 10 and passes through the siphon 11 in order to reach the second reactor 14.

In the latter, the excess carbon of the pig iron, like the silicon and the phosphorus that the latter could still contain, are eliminated from the metallic bath thanks to the oygen insufflated through the nozzle 19. As a result, the resulting decarburization slag and the pig iron form an emulsion which overflows above the second wall 16 and pours into the second decanter 15.

Once it comes to rest in the second decanter, the metal-slag emulsion slowly separates by gravity into two superposed phases: the smelted metal which continuously flows through the outlet orifice 23 and the slag floating on the metal bath and which is evacuated continuously through the overflow 20.

Figure 4:
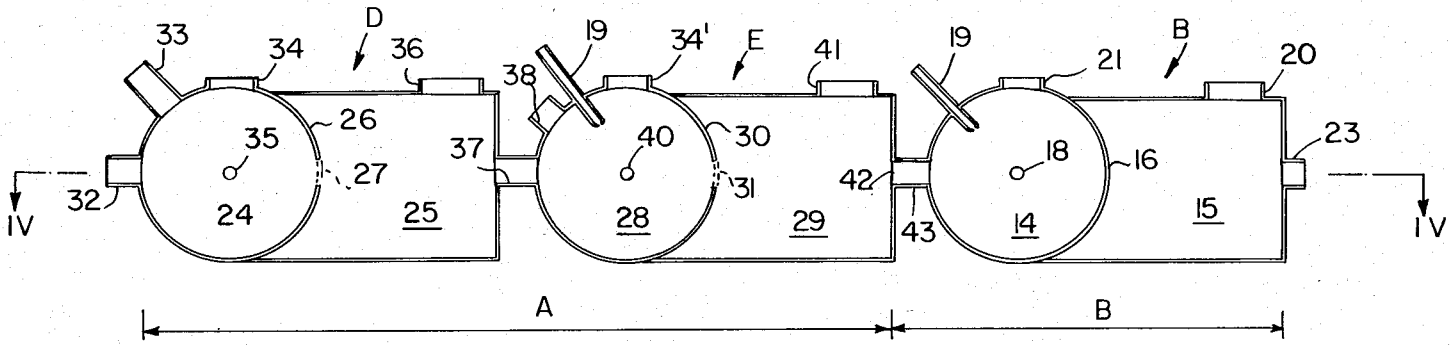
FIG. 4 is a schematic plan view of a variant of the installation shown in FIG. 1.
Figure 5:
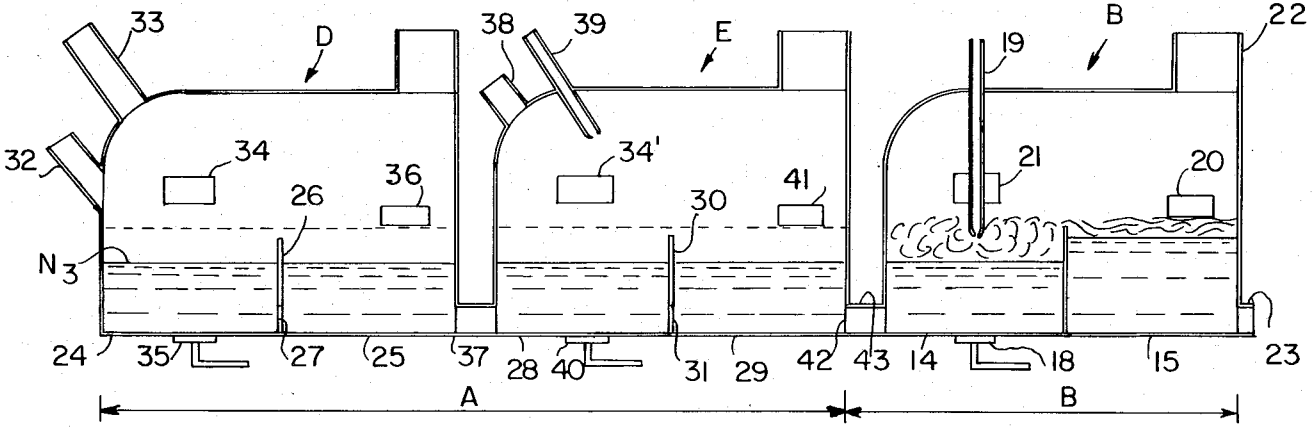
FIG. 5 is a schematic section view along line IV—IV of FIG. 4.

FIGS. 4 and 5 show an installation in which the desilication and dephosphorization stage A is divided into two adjacent and contiguous units: a desilication unit D and a dephosphorization unit E downstream of the desilication unit.

The desilication unit D comprises a reactor 24 separated from a decanter 25 by a partition 26 comprising a communication opening 27 below the level $N_3$ defined by a free surface of the pig iron to be smelted, and whose upper end is above this level.

In the same way, the dephosphorization unit E comprises a reactor 28 separated from a decanter 29 by a partition 30 comprising an opening 31 below the level $N_3$, and whose upper end is above this level. The desilication reactor 24 comprises, in its part located above the level $N_3$, means 32 for introducing the pig iron to be pre-smelted, means 33 for introducing materials for oxidation of the silicon (such as iron ore) and agents for forming a desilication slag and means 34 for introducing, if desired, cooling materials, and in its part located below the level $N_3$, rabbling means 35 such as those provided in the reactors 1 and 14 of the installation shown in FIGS. 1 to 3.

For its part, the desilication decanter 25 comprises an overflow 36 provided above the level $N_3$ for removing the desilication slag, and an opening 37 located below the level $N_3$ and communicating with the dephosphorization reactor 28.

The dephosphorization reactor 28 comprises, for its part, in its portion located above the level $N_3$, means 38 for introducing the dephosphorization agents and means 39 for creating an oxidizing atmosphere, a door 34' for the eventual introduction of cooling materials, such as scrap, and in its portion located below the level $N_3$, means 40 for rabbling the metallic bath.

In its turn, the dephosphorization decanter 29 comprises an overflow 41 provided above the level $N_3$ for removing the dephosphorization slag, and an opening 42 provided below the level $N_3$ and communicating with a conduit 43 leading to the reactor 14 of the decarburization stage B.

The installation shown in FIGS. 4 and 5 hence differs from the preceding one by its stage A in which the desilication and the dephosphorization are conducted one after the other in separate reactive enclosures instead of occurring at the same time in the same receptacle.

While the operation of this installation appears evident for the man skilled in the art, it may be specified that:

the desilication slag formed in the reactor 24 flows into the decanter 25 by overflowing above the partition 26, and is continuously evacuated therefrom by the overflow 36;

the dephosphorization slag formed in the reactor 28 flows into the decanter 29 by overflowing above the partition 30 and is continuously evacuated therefrom by the overflow 41;

the decanter 25 contains the desilicated pig iron which flows continously toward the reactor 28 along the communication passage 37;

the decanter 29 contains the desilicated and dephosphorized pig iron which flows continuously toward the decarburization stage B along the communication passage 43.

As for the decarburization stage B, its technical and functional characteristics are clearly the same as those described with reference to FIGS. 1, 2 and 3.

Provision may be made, in order to reduce iron losses through the slags, for recycling the dephosphorization slag, or at least a part, in the desilication reactor.

For the sake of completeness, it is specified that the pig iron flowing through the installation conforming to the invention may be rough blast furnace pig iron or pig iron with a substantially constant silicon content coming from a mixer.

We claim:

1. Installation for the production of steel by presmelting of pig iron comprising a stage of desilication and of dephosphorization followed by a decarburization stage, wherein said desilication and dephosphorization stage is constituted by at least one closed unit comprising (a) a first reactor (1) in which the pig iron to be presmelted forms a bath whose surface is maintained at a first predetermined level ($N_1$), said reactor having (i) an upper part above said first predetermined level ($N_1$), provided with means (5) for introducing the pig iron to be pre-smelted, means (6) for introducing agents for oxidizing silicon and phosphorus, agents for forming a desilication and dephosphorization slag, and means (8) for creating an oxidizing atmosphere above said bath; and (ii) a lower part, below said first predetermined level ($N_1$), provided with means (9) for stirring of the metallic bath; and (b) a decanter (2) separated from said first reactor (1) by a partition (3) comprising a communication opening (4) below said first predetermined level ($N_1$) and whose free upper end, extending above said first predetermined level ($N_1$) constitutes a sill encircling the slag formed in the reactor, this decanter comprising (i) an outlet opening (10) located below said first predetermined level ($N_1$) and communicating with a connecting conduit (11) to permit the circulation of a flow of desilicated and dephosphorized pig iron toward said decarburization stage; and (ii) an overflow (12) located above said first predetermined level ($N_1$) for evacuating the decanted desilication and dephosphorization slag coming from said first reactor (1) to the exterior.

2. Installation according to claim 1, wherein said decarburization stage is constituted by a closed shell (b) comprising (a) a second reactor (14) in which the pig iron to be decarburized coming from said connecting conduit (11) with said decanter (2) forms a bath whose free surface is maintained at a second predetermined level ($N_2$), said second reactor comprising an inlet opening (17) located above said second predetermined level ($N_2$) and communicating with said connecting conduit (11) as well as with means (19) located above said second predetermined level ($N_2$) for insufflating an oxidizing gas decarburizing the pig iron; and (b) a second decanter (15) separated from said second reactor (14) by a tight partition (16) whose free upper end, extending above said second predetermined level ($N_2$), constitutes a sill encircling a metal-slag emulsion formed in said second reactor (14) under the action of insufflation of said oxidizing gas, said decanter (15) having an overflow (2) for evacuating the slag decanted on the metallic bath to the exterior, and an opening (23) below the level of the metallic bath in said decanter (15) for outflow of a liquid steel current.

3. Installation according to claim 2, wherein said second reactor (14) comprises means (18) for stirring the metallic bath.

4. Installation according to claim 3, wherein said means (9) for stirring the desilication and dephosphorization stage reactor (1) and/or said means (18) for stirring said second reactor (14) are constituted by permeable refractory elements housed in the bottoms of said first and second reactors and connected to a supply of stirring gas.

5. Installation according to claim 1, wherein said desilication and dephosphorization stage is constituted by a closed desilication unit (D) and by a closed dephosphorization unit (E), each unit comprising a reactor (24, 28) separated from a decanter (25, 29) by a partition (26, 30) comprising a communication opening (27, 31) below the predetermined level ($N_3$) and having an upper end located above said level and forming an encircling sill; in that the desilication reactor (24) comprises means (32) for introducing the pig iron to be pre-smelted, means (33) for introducing the desilication agents, and stirring means (35); wherein the dephosphorization reactor (28) comprises means (38) for introducing the dephosphorization agents, means (39) for creating an oxidizing atmosphere, and means (40) for stirring the metallic bath; wherein the desilication and dephosphorization decanters (25, 29) comprise means (36, 41) for evacuating the slag which they contain; and wherein the desilication decanter (25) is connected to the dephosphorization reactor (28) by a simple transfer conduit (37), while the dephosphorization decanter (29) is connected to an immersed link conduit (42) communicating with the decarburization stage (B).

6. Installation according to any one of claims 1 to 5, wherein the desilication and dephosphorization stage (A) and/or the decarburization stage (B) are provided with means (7, 21; 34, 21) for introducing into their respective reactor cooling additives, particularly in the form of scrap.

7. Installation according to any one of claim 1 to 5, wherein the means (5; 32) for introducing the pig iron in the desilication and dephosphorization stage (A) are connected to the outlet of a mixer delivering pig iron of substantially constant silicon content.

8. Installation according to any one of claim 1 to 5, further comprising a metallurgical receptacle (C) for grading of the produced steel, connected to the outlet of the decarburization stage (B).

* * * * *